United States Patent [19]

Bird et al.

[11] Patent Number: 4,655,276

[45] Date of Patent: Apr. 7, 1987

[54] METHOD OF INVESTMENT CASTING EMPLOYING MICROWAVE SUSCEPTIBLE MATERIAL

[75] Inventors: Charles R. Bird, Colgate; John M. Mertz, St. Francis, both of Wis.

[73] Assignee: Stainless Foundry & Engineering, Inc., Milwaukee, Wis.

[21] Appl. No.: 869,260

[22] Filed: Jun. 2, 1986

[51] Int. Cl.[4] ..... B22C 1/02; B22C 9/04

[52] U.S. Cl. ..... 164/519; 164/15; 164/34

[58] Field of Search ..... 164/34, 35, 15, 519

[56] References Cited

U.S. PATENT DOCUMENTS 3,770,044 11/1973 Heath ..... 164/35

FOREIGN PATENT DOCUMENTS 56-117860 9/1981 Japan ..... 164/35

*Primary Examiner*—Kuang Y. Lin

*Attorney, Agent, or Firm*—James E. Nilles; Nicholas A. Kees

[57] ABSTRACT

A method of making an investment shell mold in such a way that the shell is protected from cracking on simultaneous firing and removal of the pattern. The method includes application of conventional molding materials in the first slurry and stucco coats. By conventional molding materials is meant molding materials that are transparent to microwaves and microwave energy. In the second slurry and/or stucco coats, and in later coats if necessary, a certain amount of microwave susceptible material, such as graphite or certain metal oxides including $Fe_2O_4$, $MnO_2$, NiO and cobalt oxide, is added. Then, if necessary to achieve sufficient mold strength, additional coats of conventional molding materials are applied. After drying is complete, the pattern and mold are exposed to microwave radiation. This radiation interacts with the microwave susceptible material to heat the pattern adjacent to the mold surface, while avoiding generalized heating of the pattern. The portion of the pattern adjacent the mold surface is melted by the heat, causing a reduction in the size of the pattern, which, in turn, results in a gap between the pattern and the mold inner surface. Then, when the mold is fired and the pattern simultaneously removed, the mold is not cracked or damaged by any expansion of the pattern.

27 Claims, 5 Drawing Figures

METHOD OF INVESTMENT CASTING EMPLOYING MICROWAVE SUSCEPTIBLE MATERIAL

BACKGROUND OF THE INVENTION

This invention relates to a method of lost foam casting and, in particular, it relates to a method of lost foam casting wherein the pattern is first reduced in size and then removed from the mold prior to pouring.

The lost wax precision casting technique is an extremely favorable molding process from many standpoints, in particular the high level of the as-cast quality of the product of lost wax molding. High as-cast quality reduces machining and manufacturing costs, allows closer cast tolerances, and overall increases productivity. Unfortunately, the lost wax process is impractical and uneconomical to use for most products in conventional steel foundries, and is limited mainly to the manufacture of relatively small components, because the wax pattern tends to shrink and distort more as the size increases. The extreme weight of larger wax patterns can also cause handling problems.

A newer process which solves some of the problems of the lost wax process was developed by the Steel Castings Research and Trade Association (SCRATA) of Great Britain and is termed the Replicast Ceramic Shell Process. This process includes the use of expanded polystyrene (EPS) in place of the wax used to form the pattern. According to SCRATA, the use of EPS offers several advantages over wax. According to SCRATA, since EPS expands less on heating, pattern removal is facilitated and the shell may be thinner and still avoid cracking. It is true that thinner ceramic shells are lighter, less expensive and easier to handle. However, applicants have found that the EPS pattern contains air and other gases which, when heated, often expand even more than wax had, and cracking of the ceramic shell can be aggravated by employing conventional mold construction methods with an EPS pattern.

This invention relates to improvments over the methods described above and to solutions to the problems raised thereby.

SUMMARY OF THE INVENTION

The invention includes a method of making an investment shell mold having a microwave susceptible material incorporated in the shell, although not in the first layer thereof. Then, when the mold and pattern therein are exposed to microwave radiation, the portion of the pattern nearest the mold is melted, causing a gap to form therebetween. Accordingly, when the mold is fired and the pattern simultaneously removed, the mold will be subjected to vastly reduced cracking pressures from expansion of the pattern on heating. In particular, the process begins with a pattern of disposable material, shaped according to the shape of the desired final product. For economy, several such patterns may be assembled to form a "cluster." According to the invention, the cluster is first dipped in a ceramic slurry of conventional molding material, and drained. Conventional stucco material is then applied, and the shell is dried. Hence, the first layer of molding material is conventional ceramic molding material. At least one layer, and if necessary subsequent layers, may be then applied thereto, containing a microwave susceptible material, such as graphite or certain metal oxides. This microwave susceptible material may be applied in the slurry coat, or in the stucco coat, or both. Depending on the intended total thickness of the mold walls, one or several additional layers of molding material impregnated with the microwave susceptible material may be applied. If more layers of molding materials still need to be applied to ensure mold strength, the formation of the shell or mold walls is then completed by applying additional layers, again using conventional molding materials. After thorough drying of the molding materials, the next step is to subject the mold and cluster to microwave radiation. The microwave energy thus applied interacts with the microwave susceptible material to create heat in the mold very near the pattern surface. Sufficient heat is created to result in the melting of the pattern material adjacent the mold surface, without excessive heating of the majority of the pattern material. A gap is thus formed between the pattern and the interior surface of the mold. This gap is sufficient to prevent shell cracking when the shell and remaining pattern are placed in a high temperature oven to simultaneously remove the remaining pattern and fire the shell.

It is thus an object of the invention to provide a method of investment shell casting wherein the first layer is of conventional molding material, the next layer or several layers are impregnated with a microwave susceptible material. If necessary, additional outer layers are again formed of conventional molding materials.

Another object of the invention is to provide a method of investment shell casting as described above wherein the mold, having certain layers impregnated with microwave susceptible materials, is subjected to microwave radiation prior to firing of the mold and simultaneous removal of the pattern material, in order to create an air gap between the pattern material and the interior wall of the mold, so as to avoid cracking of the mold upon overall heating of the pattern for removal.

Other objects and advantages of the invention will become apparent hereinafter.

DESCRIPTION OF THE PREFERRED EMBODIMENTS

In the following detailed description, the term "pattern" will be used interchangeably with the term "cluster" to refer to the pattern 10 (FIGS. 2 through 5) or a cluster formed by assembling a multiplicity of such individual patterns.

Figure 1:
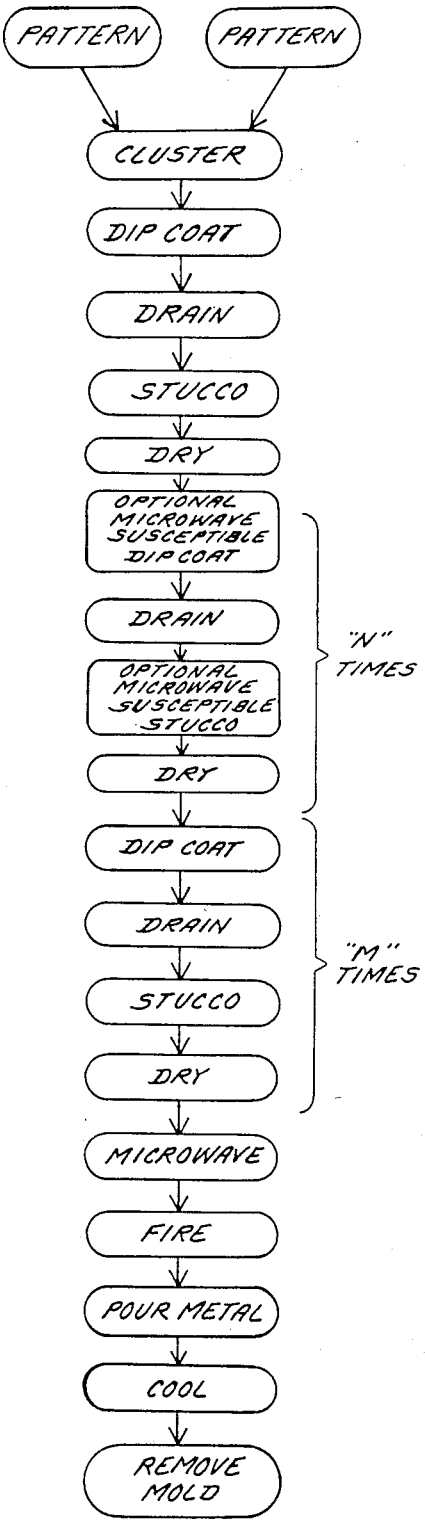
FIG. 1 is a flow diagram showing the mold formation and casting process according to one embodiment of this invention.

As illustrated in the flow diagram of FIG. 1, the sequence of operations employed in the manufacture of castings by the investment shell casting technique according to this invention includes first providing disposable patterns made from certain foam materials readily removed from the mold, and particularly expanded polystyrene (EPS), whether in bead or solid form. According to the invention, the pattern or a cluster of patterns is first dipped into an agitated slurry of conventional molding material such as a mixture of liquid binders and refractory flours. The liquid binders should preferably be taken from the following group: colloidal silica, ethyl silicate, sodium silicate, potassium silicate, and colloidal alumina. The refractory flours should preferably be taken from the following group: fused silica, zircon, alumina, aluminum silicate, chromite, olivine, magnesium oxide and quartz. The layer of slurry thus applied is then drained and, before dry, stuccoed. That is, material from the group of refractory flours listed above is again applied to the wet slurry surface and adhered thereto to form a stucco layer.

Next another layer of slurry is applied, followed by another stucco layer, except that in the case of this second layer of slurry and stucco, a certain amount of a microwave susceptible material is applied also. "Microwave susceptible material" is a type of material that efficiently converts microwave radiation energy to heat energy, analogous to the way infra-red radiation is converted to heat when it strikes a dark-colored mass. Such microwave susceptible materials, also called "coupling agents" are said to "couple" with the microwave radiation when they accomplish this conversion. Some examples of microwave susceptible materials are water, certain organic resins, graphite and certain metal oxides including $Fe_3O_4$, $MnO_2$, NiO and cobalt oxide. In the present invention, however, it is also necessary that the microwave susceptible materials remain in place in the mold, that they not reduce the strength of the mold excessively and that they do not adversely affect as-cast quality. Water is not generally suitable because it evaporates at too low a temperature and thus does not remain in the mold. Resins are generally inefficient coupling agents and require high concentrations in order to achieve reasonable effect, and in addition resins often leave undesirable ash residue on mold burnout which can attack the ceramic shell and cause premature failure, especially in the high concentrations required. The metal oxides listed above, while efficient coupling agents, are relatively expensive. Graphite, on the other hand, is commonly available, is economical, is inert with respect to ceramic shell chemistry, remains in place at the necessary temperatures, and couples with microwave energy efficiently.

The size of the particles of microwave susceptible material is of little practical significance, since the microwave heating effects take place on an extremely minute level. However, excessively fine particles present handling difficulties while excessively coarse particles can reduce the strength of the ceramic mold, so that the particle size should be in the range of from 120 mesh to 600 mesh, more preferably between 120 and 400 mesh, and most preferably between 120 and 200 mesh. The microwave susceptible material should be about 4 to 15 percent by weight of the material applied, and preferably 4 to 10 percent by weight. As shown in FIG. 1, the slurry and stucco impregnated with microwave susceptible materials are applied N times. Optionally, the microwave susceptible material may be applied in only the slurry coat or in only the stucco coat. Then, if necessary, conventional refractory molding materials may be applied in slurry and stucco coats M times in order to fill out the mold wall to the necessary thickness as required for the particular mold for strength and other handling reasons, although there may certainly be applications where M may be zero since enough strength is provided by the layers having microwave susceptible materials.

Factors which affect the parameters of the method include the size and shape of the mold, the type of microwave susceptible material chosen to be added to the mold, the concentration of the microwave susceptible material in the mold and equipment limitations in general, such as the microwave field strength of the particular microwave oven used. Since certain of these items are predetermined by external factors, such as size and shape of the mold and microwave field strength (at least the maximum of which is determined by the capacity of the oven), and the particular type of microwave susceptible material is often determined by cost factors, the optimum concentration and time of exposure for a particular size and shape of mold in an oven having known field strength may easily be determined in one or a few experimental preproduction runs.

Figure 2:
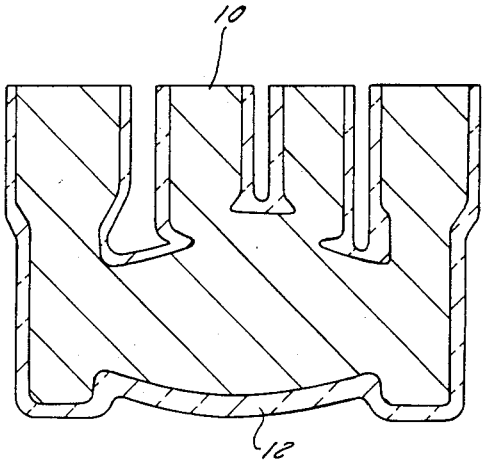
FIG. 2 is a schematic sectional view through a pattern and mold formed in accordance with the practice of the present invention.
Figure 3:
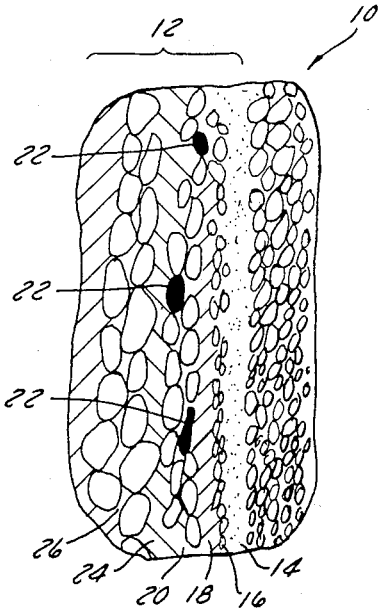
FIG. 3 is an enlarged view of a portion of FIG. 2, showing detail of the various layers of molding material applied to the pattern.

Referring to FIGS. 2 and 3, then, the result is a pattern 10, preferably of expanded polystyrene, shaped according to the shape of the desired product, and coated with a mold 12 of refractory material, comprising in this case a total of three layers of molding material, each having a slurry coat and a stucco coat, except that the outer layer often has only a slurry coat. As can be seen best by reference to FIG. 3, the mold 12 includes a first slurry coat 14 and first stucco coat 16 having no graphite or other microwave susceptible material therein. Either the second slurry coat 18 or the second stucco coat 20, or both, will have particles of microwave susceptible material 22 added. Additional coats having microwave susceptible material (not shown) may also be added as necessary. The outer layers of slurry 24 and stucco 26 will generally again be conventional layers of refractory molding material, having no microwave susceptible material therein although, as stated above, there may certainly be applications where sufficient strength is provided by the layers having microwave susceptible materials.

Figure 4:
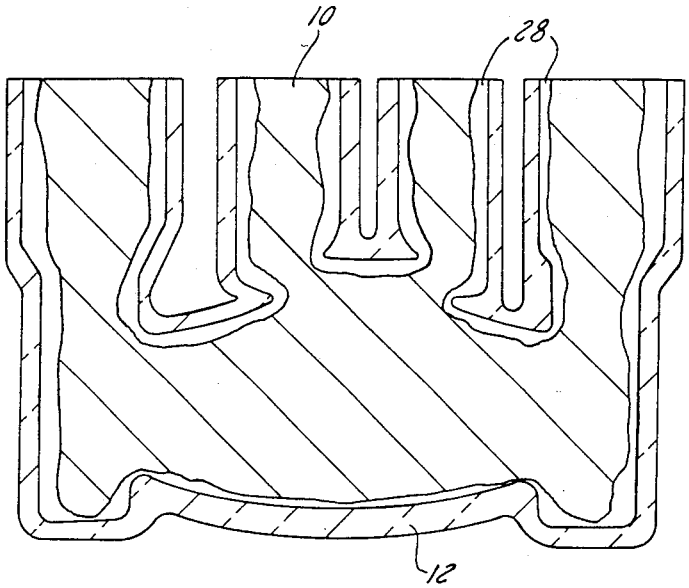
FIG. 4 is a view similar to FIG. 2 after the application of microwave energy to shrink the pattern away from the mold and provide a gap or amount of space therebetween.
Figure 5:
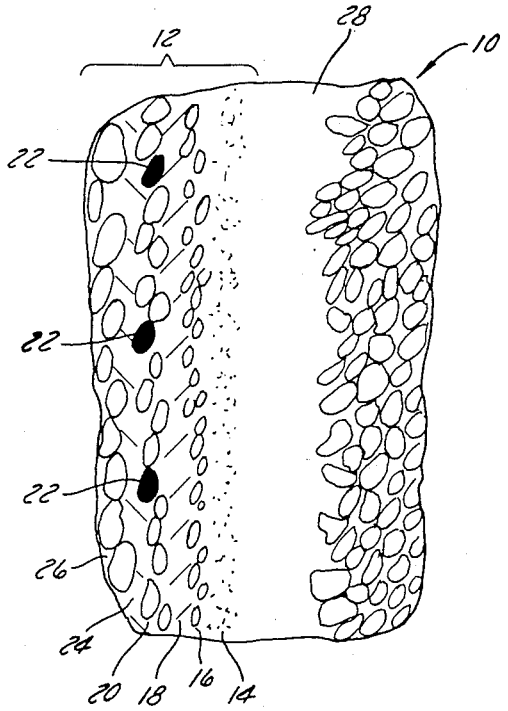
FIG. 5 is an enlarged view of a portion of FIG. 4, similar to FIG. 3, except that a gap has formed between the shrunken pattern and the mold surface.

As shown in FIG. 1, the next step in the process, after the last layer of slurry and stucco are dried, is to apply microwave energy to the mold 12 and pattern 10. Since the pattern materials, whether expanded polystyrene or other foam materials, are transparent to microwaves, and since the conventional refractory materials contained in the mold surface 12 are also transparent to microwaves, the only items affected by the microwaves are the particles 22 of microwave susceptible material. Since the particles 22 are of a microwave susceptible material, their exposure to microwave energy causes their temperature to increase. In turn, the material of the pattern nearest the mold interior wall is melted and draws away from the wall itself, leaving a gap 28 therebetween, as shown in FIGS. 4 and 5. Ideally the reduction in size of the pattern 10 should be in the area of at least twenty percent. Greater reductions in size are not in the least undesirable, except from the standpoint that it wastes energy and machine time.

The microwave field strength and the length of time of exposure required is governed by the size and shape parameters of the particular mold and pattern employed. As stated earlier, the mold should be exposed to microwaves until the pattern reaches the desired size reduction. The applicants have found that sufficient reduction is generally achieved if the mold is placed in a microwave oven having an approximate interior capacity of 1.5 cubic feet and a maximum wattage rating of 800 watts, or other equivalent volume and wattage ratings. The length of time of exposure is generally determined by the mass and shape of the mold. The applicants have found that for a rectangular solid material having volume of about two to four cubic inches an exposure time of 5 to 6 minutes produces a sufficient size reduction of the pattern depending, as previously stated, upon the materials and concentrations employed.

Referring again to FIG. 1, the next step in the process is to fire the mold, as is conventionally done to remove volatiles and provide adequate bonding. At the same time, since the pattern has not yet been removed, this firing serves to remove it by melting it at these high firing temperatures. Since the pattern has been reduced in size by the microwave step previously described, any expansion of the pattern before its general melting does not endanger the mold, and cracking is avoided. Once the mold is fired and the pattern removed, the metal is poured and cooled and the mold removed therefrom conventionally.

The molds of the present invention and their method of manufacture are further illustrated in the following examples:

EXAMPLE 1

A pattern formed of expanded polystrene of approximately two cubic inches in size and generally rectangular in shape was first dipped in a slurry of colloidal silica, fused silica and zircon. Next a stucco coat of fused silica and zircon was applied. Then the pattern was dipped in a slurry of colloidal silica, fused silica and zircon, containing in addition 4% graphite, having a particle size of −200 mesh. Another stucco coat of fused silica and zircon was then applied. This cycle of a 4% graphite slurry coat and a stucco coat was followed once more. Then the pattern was dipped in a slurry of colloidal silica, fused silica and zircon, with no graphite, and a stucco coat of fused silica and zircon was applied. Finally another non-graphite slurry coat and stucco coat were applied. The mold was then placed in an 800 watt microwave field for 6 minutes. The pattern had separated from the shell and had almost completely melted away. After normal firing, which in addition removed any remaining pattern, the shell was ready for use.

EXAMPLE 2

A pattern formed of expanded polystrene of approximately four cubic inches in size and generally rectangular in shape was first dipped in a slurry of colloidal silica, fused silica and zircon. Next a stucco coat of fused silica and zircon was applied. Then the pattern was again dipped in the slurry of colloidal silica, fused silica and zircon. A stucco coat of fused silica and zircon with 7.7% pulverized graphite having a particle size of −20 mesh was then applied. Then the pattern was again dipped in the slurry of colloidal silica, fused silica and zircon. The mold was then placed in an 800 watt microwave field for 5 minutes. The pattern had separated from the shell and had reduced in size to 50% of its original volume. After normal firing, which in addition removed any remaining pattern, the shell was ready for use.

EXAMPLE 3

A pattern formed of expanded polystrene of approximately four cubic inches in size and generally rectangular in shape was first dipped in a slurry of colloidal silica, fused silica and zircon. Next a stucco coat of fused silica and zircon was applied. Then the pattern was again dipped in the slurry of colloidal silica, fused silica and zircon. A stucco coat of fused silica and zircon with 7.7% pulverized graphite having a particle size of −20 mesh was then applied. Then the pattern was again dipped in the slurry of colloidal silica, fused silica and zircon. Another stucco coat of the fused silica, zircon and 7.7% pulverized graphite having a particle size of −20 mesh was applied, followed by another dip in the slurry of colloidal silica, fused silica and zircon. The mold was then placed in an 800 watt microwave field for 5 minutes. The pattern had separated from the shell and had reduced in size to 50% of its original volume. After normal firing, which in addition removed any remaining pattern, the shell was ready for use.

While the method hereinbefore described is effectively adapted to fulfill the aforesaid objects, it is to be understood that the invention is not intended to be limited to the particular preferred embodiments of a method of investment casting employing microwave susceptible material herein set forth. Rather, it is to be taken as including all reasonable equivalents without departing from the scope of the appended claims.

I claim:

1. A method of making an investment shell mold, said method comprising:

applying a slurry coat of microwave transparent materials to a disposable pattern, said pattern being formed in the shape of the desired final product of the mold;

applying a stucco coat of microwave transparent materials to said pattern;

applying at least one slurry coat of microwave transparent materials to said pattern, said at least one slurry coat having a small amount of microwave susceptible materials mixed therein;

applying at least one stucco coat of microwave transparent materials to said pattern, said at least one stucco coat having a small amount of microwave susceptible materials mixed therein;

applying a sufficient number of additional slurry and stucco coats of microwave transparent materials so as to give the resulting mold sufficient strength for the molding process;

and exposing the resulting mold and pattern to microwave energy until said pattern shrinks away from the mold, leaving a gap therebetween.

2. A method as recited in claim 1 wherein the amount of microwave susceptible materials mixed in said at least one slurry coat and said at least one stucco coat is 4% to 15% by weight.

3. A method as recited in claim 2 wherein the amount of microwave susceptible materials mixed in said at least one slurry coat and said at least one stucco coat is 4% to 10% by weight.

4. A method as recited in claim 3 wherein the microwave susceptible material was chosen from the group consisting of graphite and the following metal oxides: $Fe_3O_4$, $MnO_2$, NiO and cobalt oxide.

5. A method as recited in claim 4 wherein the particle size of the microwave susceptible material is from 120 mesh to 600 mesh.

6. A method as recited in claim 5 wherein the particle size of the microwave susceptible material is from 120 mesh to 400 mesh.

7. A method as recited in claim 6 wherein the particle size of the microwave susceptible material is from 120 mesh to 200 mesh.

8. A method as recited in claim 1 wherein said pattern and mold are exposed to microwave energy equivalent to that in an 800 watt microwave oven having an interior volume of about 1.5 cubic feet.

9. A method as recited in claim 8 wherein said pattern shrinks in size by at least 20%.

10. A method of making an investment shell mold, said method comprising:

applying a slurry coat of microwave transparent materials to a disposable pattern, said pattern being formed in the shape of the desired final product of the mold;

applying a stucco coat of microwave transparent materials to said pattern;

applying a second slurry coat of microwave transparent materials to said pattern;

applying at least one stucco coat of microwave transparent materials to said pattern, said at least one stucco coat having a small amount of microwave susceptible materials mixed therein;

applying a sufficient number of additional slurry and stucco coats of microwave transparent materials so as to give the resulting mold sufficient strength for the molding process;

and exposing the resulting mold and pattern to microwave energy until said pattern shrinks away from the mold, leaving a gap therebetween.

11. A method as recited in claim 10 wherein the amount of microwave susceptible materials mixed in said at least one stucco coat is 4% to 15% by weight.

12. A method as recited in claim 11 wherein the amount of microwave susceptible materials mixed in said at least one stucco coat is 4% to 10% by weight.

13. A method as recited in claim 12 wherein the microwave susceptible material was chosen from the group consisting of graphite and the following metal oxides: $Fe_3O_4$, $MnO_2$, NiO and cobalt oxide.

14. A method as recited in claim 13 wherein the particle size of the microwave susceptible material is from 120 mesh to 600 mesh.

15. A method as recited in claim 14 wherein the particle size of the microwave susceptible material is from 120 mesh to 400 mesh.

16. A method as recited in claim 15 wherein the particle size of the microwave susceptible material is from 120 mesh to 200 mesh.

17. A method as recited in claim 10 wherein said pattern and mold are exposed to microwave energy equivalent to that in an 800 watt microwave oven having an interior volume of about 1.5 cubic feet.

18. A method as recited in claim 17 wherein said pattern shrinks in size by at least 20%.

19. A method of making an investment shell mold, said method comprising:

applying a slurry coat of microwave transparent materials to a disposable pattern, said pattern being formed in the shape of the desired final product of the mold;

applying a stucco coat of microwave transparent materials to said pattern;

applying at least one slurry coat of microwave transparent materials to said pattern, said at least one slurry coat having a small amount of microwave susceptible materials mixed therein;

applying a sufficient number of additional stucco and slurry coats of microwave transparent materials so as to give the resulting mold sufficient strength for the molding process;

and exposing the resulting mold and pattern to microwave energy until said pattern shrinks away from the mold, leaving a gap therebetween.

20. A method as recited in claim 19 wherein the amount of microwave susceptible materials mixed in said at least one slurry coat is 4% to 15% by weight.

21. A method as recited in claim 20 wherein the amount of microwave susceptible materials mixed in said at least one slurry coat is 4% to 10% by weight.

22. A method as recited in claim 21 wherein the microwave susceptible material was chosen from the group consisting of graphite and the following metal oxides: $Fe_3O_4$, $MnO_2$, NiO and cobalt oxide.

23. A method as recited in claim 22 wherein the particle size of the microwave susceptible material is from 120 mesh to 600 mesh.

24. A method as recited in claim 23 wherein the particle size of the microwave susceptible material is from 120 mesh to 400 mesh.

25. A method as recited in claim 24 wherein the particle size of the microwave susceptible material is from 120 mesh to 200 mesh.

26. A method as recited in claim 19 wherein said pattern and mold are exposed to microwave energy equivalent to that in an 800 watt microwave oven having an interior volume of about 1.5 cubic feet.

27. A method as recited in claim 26 wherein said pattern shrinks in size by at least 20%.

* * * * *